United States Patent [19]

Lundwall

[11] Patent Number: 4,969,398

[45] Date of Patent: Nov. 13, 1990

[54] LANE MARKER

[75] Inventor: Neal M. Lundwall, Ridgecrest, Calif.

[73] Assignee: The United States of America as represented by the Secretary of the Navy, Washington, D.C.

[21] Appl. No.: 445,571

[22] Filed: Dec. 4, 1989

[51] Int. Cl.[5] ..... F42B 12/40; F42B 30/00

[52] U.S. Cl. ..... 102/293; 102/363; 102/401; 102/425; 102/513

[58] Field of Search ..... 102/401, 425, 498, 293, 102/513, 529

[56] References Cited

U.S. PATENT DOCUMENTS

| | | | |
|---|---|---|---|
| 4,007,690 | 2/1977 | Wildridge | 102/293 |
| 4,326,463 | 4/1982 | Burke et al. | 102/513 |
| 4,438,700 | 3/1984 | Knapp | 102/498 |
| 4,656,092 | 4/1987 | Haman et al. | 102/513 |
| 4,706,568 | 11/1987 | Lundwell et al. | 102/513 |
| 4,714,021 | 12/1987 | Tranin | 102/401 |

*Primary Examiner*—David H. Brown

*Attorney, Agent, or Firm*—Sol Sheinbein; Melvin J. Sliwka; Harvey A. Gilbert

[57] ABSTRACT

A lane marker preferably for delivery by a CATFAE weapon, has a mechanical timed device which is positioned and rides in the rear section of the CATFAE weapon as it is launched to a specified position on the ground. At first contact of the CATFAE with the ground, the lane marker is ejected vertically a short distance away from the ground and then falls onto the ground. On the ground the lane marker attitude is controlled for effective employment. Spring-biased probes deploy the makers which typically comprise two flags and two chemiluminescent lights to mark the impact point of the CATFAE. The two chemiluminescent lights are activated mechanically by cloud detonation overpressure prior to deployment of the spring-biased probes.

18 Claims, 3 Drawing Sheets

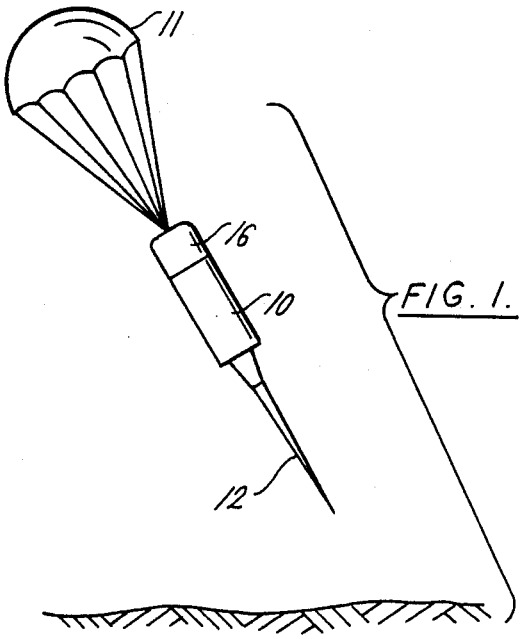
FIG. 1.
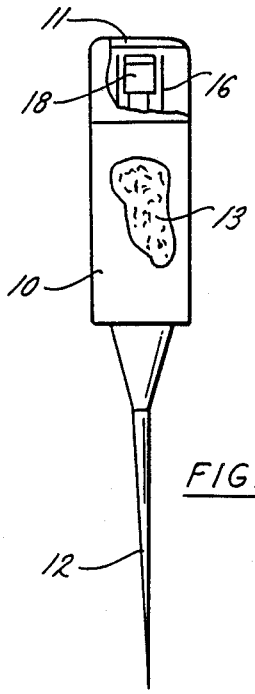
FIG. 2.
FIG. 3.
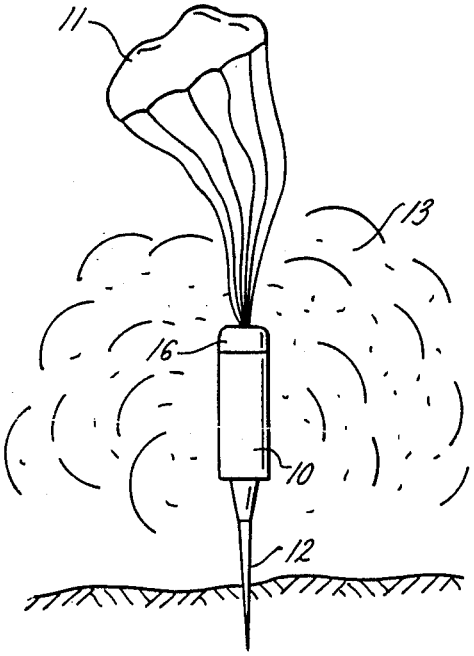
FIG. 4.
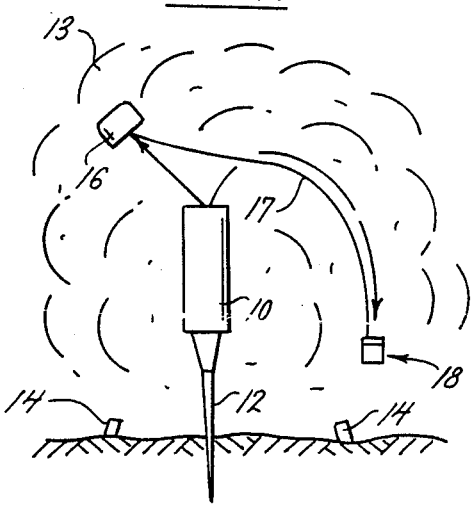

FIG. 9.
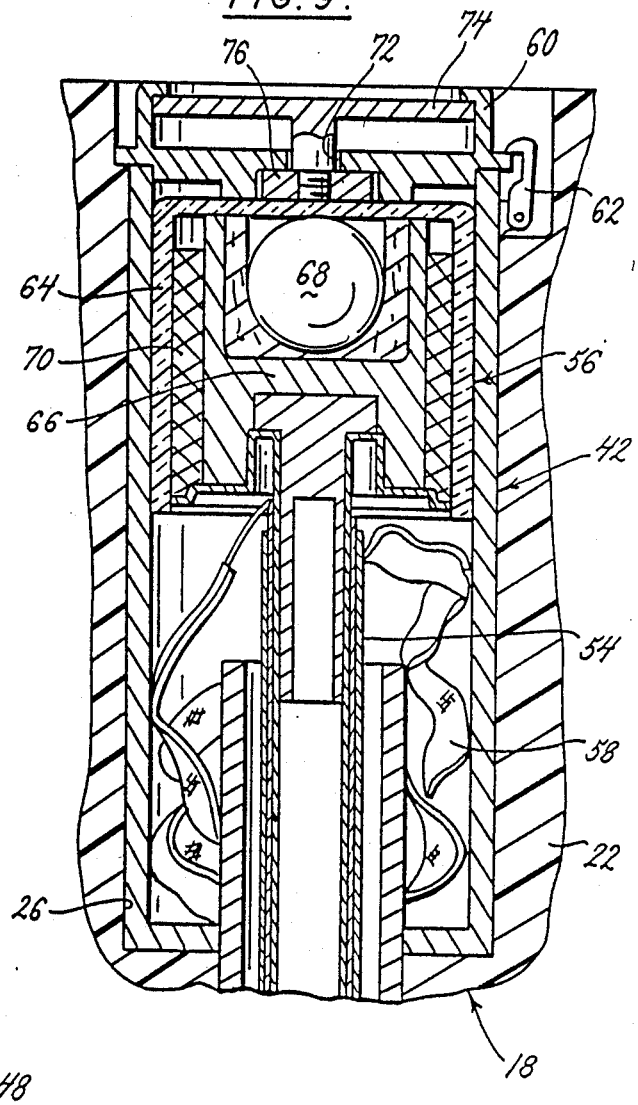
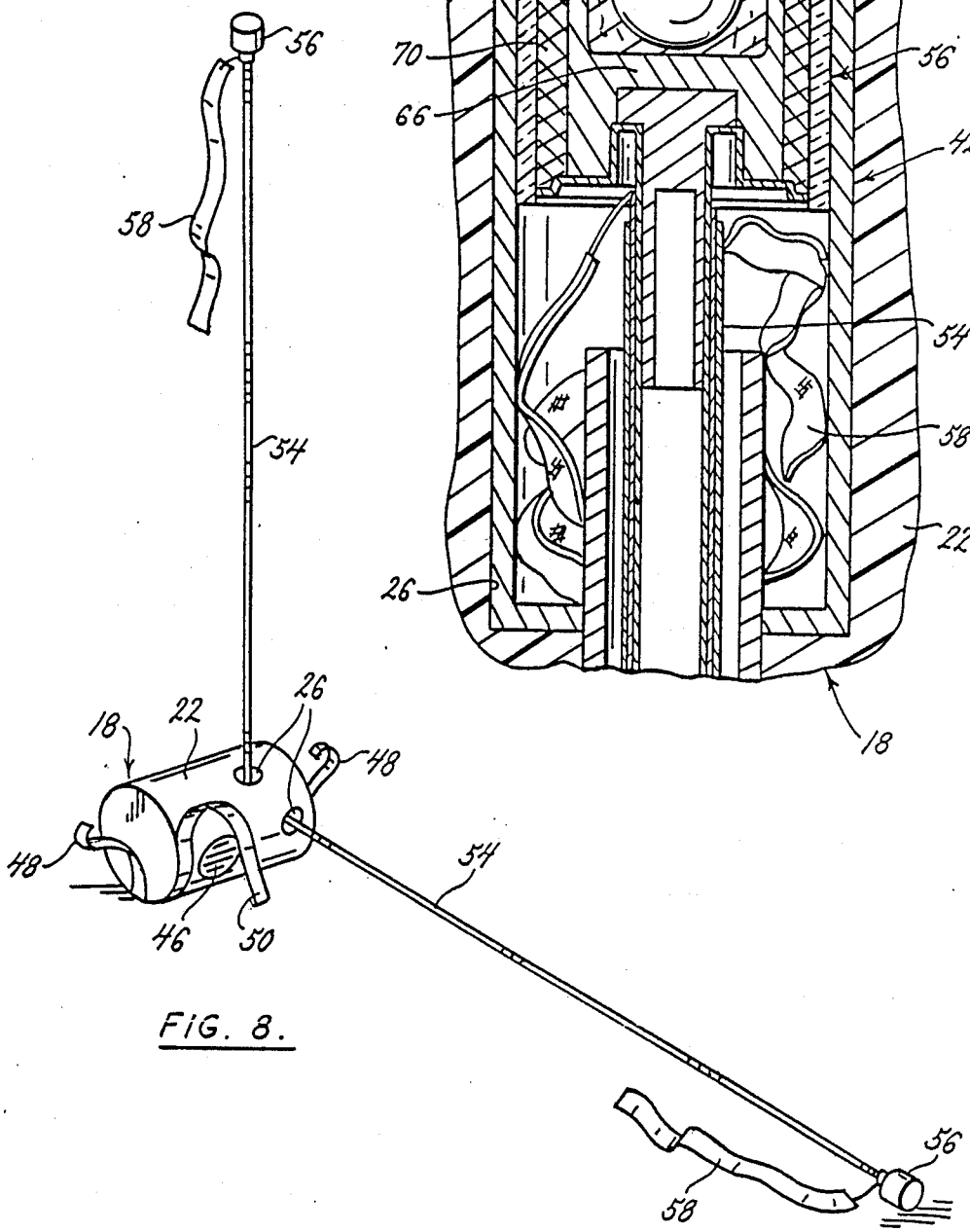
FIG. 8.

LANE MARKER

BACKGROUND OF THE INVENTION

The present invention relates in general to an apparatus for marking the post-detonation safe area within a mined terrain and pertains, more particularly, to a lane marking device mounted and carried on the aft portion of a catapult-launched fuel air explosive weapons system (CATFAE) for deploying markers for marking a safe area within a terrain containing unmarked and undetonated explosives. The lane marker of this invention is an improvement over the conventional lane marker.

With conventional marker systems it is generally necessary to manually place marking flags for daylight visibility and set flares for nighttime visibility to define a safe area within a terrain with unmarked and undetonated explosives. However, manually placing markers subjects operations personnel to substantial risk arising from the fact that maintaining darkness or a low level of illumination is often desirable in the field. Thus, under field conditions, operations personnel must place the markers without being certain of the location of unexploded devices, even after detonation has occurred. Another drawback associated with the conventional marking systems is the general risk to personnel from unexploded or hidden mines, whether day or night, when manually placing either flags or flares.

Co-pending application, Serial No. 332,851, now U.S. Pat. No. 4,901,644 describes an improvement over conventional marking systems in which a post-detonation safe area is visibly marked within the boundaries of an otherwise explosive environment, both during nighttime dark conditions and full-visibility daylight conditions. Marking, as disclosed in the co-pending application, is generally accomplished by deploying a marker housing with subsequent outward deployment from the marker housing of telescoping members bearing flags for daytime marking and chemiluminescent light sticks for nighttime apparatus and location marking. In operation, an overpressure condition created by the detonation of an explosive cloud activates a timer operatively securing a lid containing the markers. At a pre-set time, the lid is released and a previously coiled telescoping member extends beyond the housing and a tapered end carries the day and night markers. A drawback of the invention of the co-pending application is the method of initiation of the chemiluminescent light source. The invention of the co-pending application has been improved upon by the present invention.

Accordingly, it is an object of the present invention to provide an improved lane marker having an assembly that is adapted for ejection from a CATFAE after impact of the CATFAE. A mechanical timer device controls the opening of marker compartments in a housing carried by the assembly and further controls the subsequent deployment of the markers.

Another object of the present invention is to provide an improved lane marker with mechanical activation of a chemiluminescent light source.

A further object of the present invention is to provide an improved lane marker having a light source initiator that does not activate the light source until just before deployment of the lane markers by one or more outwardly biased probes.

SUMMARY OF THE INVENTION

To accomplish the foregoing and other objects of this invention there is provided an apparatus for marking a lane with respect to a post-detonation safe area within an explosive terrain wherein the safe area is within surrounding terrain containing unmarked and still undetonated explosives. The lane marker comprises a marking apparatus assembly including means for housing a plurality of lane markers, the assembly and its associated housing means adapted for delivery to a desired area by a remotely launched device. In a preferred embodiment the lane marking apparatus assembly and associated housing are mounted and carried on the aft portion of a catapult-launched fuel air explosive weapons system (CATFAE). The marking apparatus assembly is initially deployed by ejection from the weapons system by an operatively associated ejection means. Markers extend out from the housing means on extension members or probes that are activated in response to an initiator responding to an external pressure source. The illustrated embodiment includes a flag for daytime visual marking and a chemiluminescent light source for nighttime marking, both markers extended outwardly from the housing means on their respective spring biased probes. Means are provided for determining the post-ejection attitude of the marking apparatus in order to insure that at least one of the marker probes extends outwardly from the housing at an angle with the ground of at least 45°. The preferred embodiment illustrated in accordance with the description below includes a spring member to insure that the housing rests on its side and additional spring members to insure extension of a probe housing at a desired angle.

These and other objects and features of the present invention will be better understood and appreciated from the following detailed description of one embodiment thereof, selected for purposes of illustration and shown in the accompanying drawings.

BRIEF DESCRIPTION OF THE DRAWINGS

FIG. 1 is an illustration of a parachute suspended carrier used to deploy a lane marker of the present invention;

FIG. 2 is a partial cutaway view of the carrier illustrated in FIG. 1;

FIG. 3 is another illustration of the carrier used to deploy this invention shown after impact in an explosive hazard area such as a mine field, and release of its parachute, an explosive fuel, cloud and cloud detonators;

FIG. 4 is another illustration of the carrier for the lane marker of this invcntion after fuel cloud and cloud detonator deployment and release of the lane marker;

FIG. 8 is a depiction of a pair of marker probes deployed from a marker housing; and FIG. 9 is a partial cross-sectional view taken along line 9—9 in FIG. 7.

DETAILED DESCRIPTION

Figure 6:
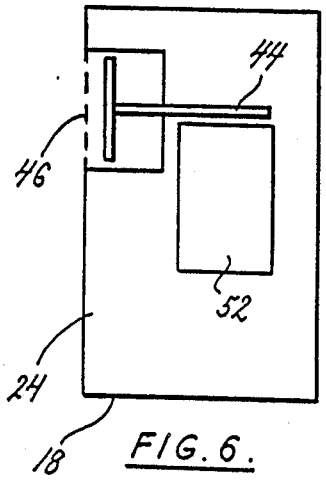
FIG. 6. is a schematic illustration of a lane marker housing.

Referring now to the drawings there is shown a preferred embodiment of the lane marker of this invention.

The lane marker is described in connection with an apparatus for marking a post-detonation safe area within a mined terrain. The lane marker of the present invention is particularly adapted for providing a lane marking device mounted and carried on the aft portion of a catapult-launched fuel air explosive weapons system (CATFAE) for deploying markers for marking a safe area within a terrain containing unmarked and undetonated explosives and is further characterized by light source initiation and probe deployment attitude control.

The drawings show a lane marker apparatus assembly 18 in conjunction with a carrier 10, such as a catapult-launched fuel air explosive weapons system (CATFAE) for deploying markers for marking a safe area within a terrain containing unmarked and undetonated explosives. The carrier 10 is typically lowered beneath a parachute 11 into an explosive hazard environment such as a mine field. A fuze 12 is shown on an end of the carrier 10 facing the ground. A fuel is used to create an explosive fuel cloud 13 above the landing area and within the explosive environment and one or more cloud detonators 14, are illustrated along with the lane marker apparatus assembly 18 within the carrier 10 in FIGs. 2 and 4.

The fuze 12 contacts the ground causing the release of the lane marker apparatus assembly 18 which remains secured relative to the carrier 10 by a tether 17. In a typical CATFAE deployment one or more fuel cloud detonators 14 are deployed simultaneously as illustrated in FIG. 4. The carrier is intended to burst approximately ten milliseconds after detonator deployment and disperse the fuel cloud 13. The detonators are intended to ignite the fuel cloud approximately two hundred milliseconds into its formation.

Figure 5:
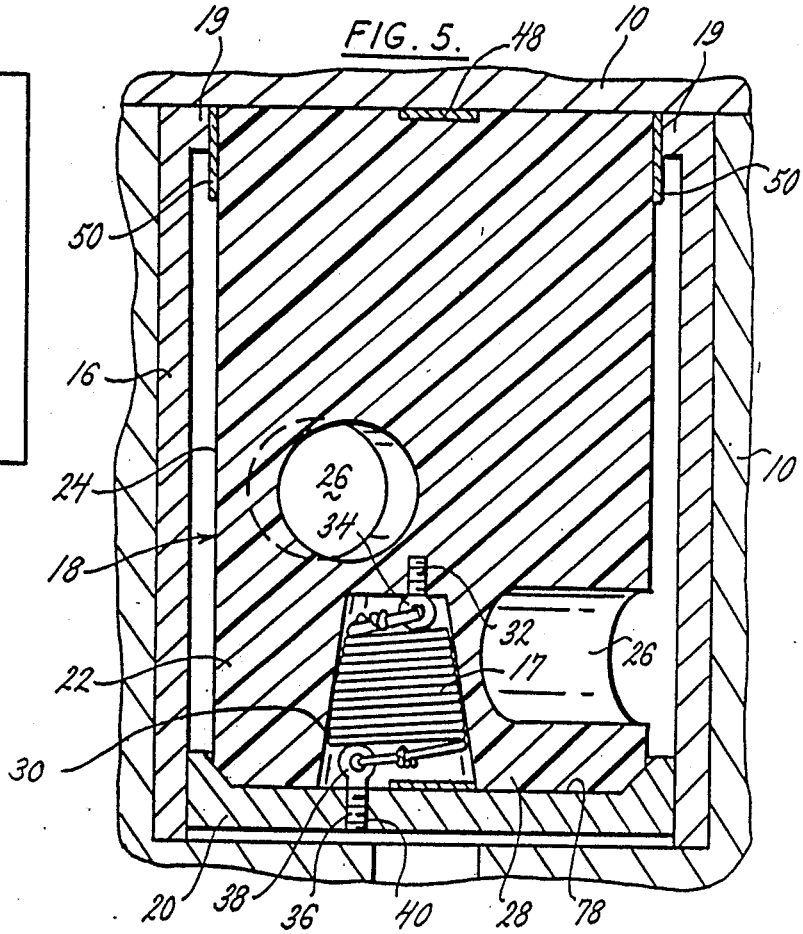
FIG. 5 is a sectional view of a lane marker within an ejection tube of a carrier.

The lane marker apparatus assembly 18 is illustrated schematically in FIG. 5 within an ejection tube 16. A lip 19 extends around an open end of the ejection tube 16 in order to maintain the position of the lane marker apparatus assembly 18 when it is within the ejection tube 16. In addition, the lip 19 acts as a stop for a piston 20 typically located at a bottom of the ejection tube 16 upon which the bottom of the lane marker apparatus assembly 18 rests prior to deployment.

The lane marker apparatus assembly 18 consists of a housing 22 which has an outside wall 24, a plurality of probe compartments 26 and a generally solid portion 28. The housing 22 of the preferred embodiment is a temperature and shock resistant nylon capable of use in an explosive environment. A conical chamber 30 extends generally upoward from the flat base of the lane marker. An eyebolt 32 extends into the conical chamber 30 and in particular an eye 34 of the eyebolt 32. A length of nylon tether 17, approximately forty-four inches long is coiled within the chamber 30 at the base of the lane marker apparatus assembly 18 during pre-deployment storage of the lane marker apparatus assembly 18 within the carrier 10. An end of the nylon tether 17 is secured to eye 34 of the eyebolt 32. Another end of the nylon tether 17 is secured to another eyebolt 36 through eye 38. The eyebolt 36 is threaded into a mating, threaded hole 40 in the piston 20 located beneath the generally solid portion 28 of the lane marker apparatus assembly 18 within the ejection tube 16.

A lane marker disclosed in co-pending application Serial No. 332,851 consists of a cylindrical container approximately 3.5 inches diameter by approximately 4.5 inches long with a lid on one end. An external pressure activates a timer within the container. Upon completion of a timing cycle the lid opens and three probes (legs) extend along the lines of a tetrahedron and display flags and chemical lights at the ends of the probes.

The lane marker of the present invention also consists of a cylinder approximately 3.5 inches diameter and approximately 4.5 inches in length constructed of a shock resistant nylon or equivalent material. It will be understood, therefore, that it is intended for the same weapon system to deliver this invention and the invention disclosed in the co-pending application.

Figure 7:
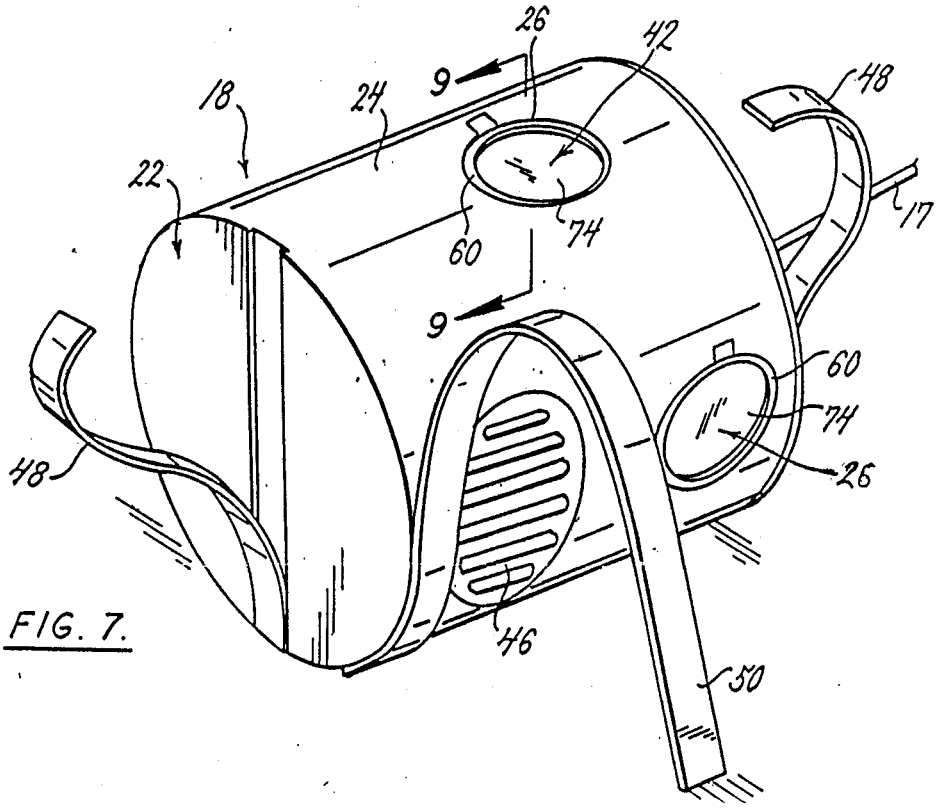
FIG. 7 is illustration of a housing after ejection from a carrier.

The housing 22 includes a plurality of probe housings or compartments 26. Two probe housings 42 are preferred and are illustrated in the drawings. The typical probe housing assembly will be described below. The lane marker of the present invention further includes an initiator device 44 seen in FIG. 6 as means for initiating deployment of the probes, an initiator guard 46, shown in FIGS. 6 and 7, a plurality of attitude control members including spring members and preferably two end springs 48 and one spiral spring 50. Also included in the housing 22 are a timer and release mechanism 52. The spiral spring 50 is preferably mounted near an end of the housing 22 and generally about its circumference.

End springs 48 and spiral spring 50 provide attitude control for the final attitude or position of the lane marker housing 22 after ejection from the carrier 10 as it falls to the ground. End springs 48 are provided to prevent the lane marker housing 22 from coming to rest in a final ground position in which the housing is on end. The spiral spring 50 assures that the deployment axis of one or both probe compartments or housings is at least 45° with respect to the surrounding terrain.

The preferred embodiment illustrated and described includes a plurality of probe housings or compartments 26 and preferably two probes and two probe housings. Each probe housing 26 includes a spring probe 54 for extension or deployment of the markers at least eighteen inches outward of the housing 22 and along a longitudinal axis of each probe housing. Each spring biased probe 54 carries two types of markers, a chemiluminescent light source 56 for night marking and a flag 58 for daytime marking. The markers are attached to the end of their respective spring probes.

The light source 56, flag 58, and spring biased probe are contained within their respective probe housings 26 by a closure means such as a lid 60 and means for releasing the lid such as a release latch 62.

A feature of the present invention is that the chemiluminescent light source is activated by the pressure created by the detonation of the fuel cloud 13.

The chemiluminescent light source 56, illustrated in FIG. 9, includes an outer case 64 and an inner support casing 66. A typical structural arrangement for a chemiluminescent light source consists of an oxidizer solution containing glass ampule 68 approximately 12mm in diameter by .87 inch in length, filled with a conventional oxidizer solution. The outer case 64 contains a green flourescer solution 70.

A preferred probe housing or compartment 26 includes the probe housing lid 60 that further defines a hole or passageway 72. A piston 74 extends through hole 72 in the lid and is fastened on the opposite side of the lid by a piston collar 76. The piston and collar assembly are free to slide within the hole or passageway 72 defined by the lid 60. The probe compartments are spaced apart approximately 90° in a preferred embodiment and each probe housing longitudinal axis is substantially perpendicular to a longitudinal housing axis defined by the housing 22. It will be understood from FIG. 5 that a base 78 of the housing 22 is shaped to be accommodated within the carrier ejection piston 20.

The spring probes 54 may be a helical coiled, spring-like, stainless steel, telescoping members secured to the inside base of their respective probe compartments 26. The flags 58 may be tied to the ends of the probes 54 in a suitable fashion.

In operation, in connection with the CATFAE previously mentioned to deliver the lane marker to the hazardous, explosive terrain environment, such as a mine field, the carrier 10 is used to transport the detonation means for clearing a safe area within the hazardous terrain and deploying the lane marker apparatus assembly 18 with its associated markers for marking the safe area. The carrier 10, such as a CATFAE round, is launched into the particular area of the hazardous environment to be made safe. A CATFAE-type carrier is lowered by the parachute 11 near the terminal end of its trajectory. The carrier 10 impacts as illustrated in FIG. 3 such that the fuze 12 on the end of the carrier 10 opposite the parachute 11 makes the initial contact with the ground, thus triggering release of the cloud detonators and the lane marker and causing the release of the explosive fuel cloud 13 approximately 10 milliseconds later. With reference to FIGS. 4 and 5, the initiation of a small detonator causes the piston 20 to move down the ejection tube 16 until contact with lips 19 in such a way that the lane marker apparatus assembly 18 resting thereon is expelled from the ejection tube 16. When the ejection tube 16 is on the ground, the lane marker apparatus assembly 18 is connected to it by means of the nylon tether 17. The piston 20 remains in the ejection tube 16 and the nylon tether 17 is connected to the piston 20. The travel of the lane marker apparatus assembly 18 away from the ejection tube 16 is thus limited to the extent of the length of the nylon tether 17. This length in a preferred embodiment is approximately forty-four inches.

Prior to expulsion of the lane marker apparatus assembly 18 from the ejection tube 16, the tether 17 is stored within the chamber 30 in the base of the generally solid portion 28 of the lane marker apparatus assembly 18. In a preferred embodiment of this invention one end of the nylon tether 17 is attached to the eye 38 in the eyebolt 36 extending through the piston 20, and the other end of the nylon tether 17 extends through the eye 34 in the eyebolt 36 which is connected by threading to a threaded receiving portion in the lane marker apparatus assembly 18.

When the fuel cloud detonators 14 explode, the fuel cloud 13 is permitted to be exploded, thereby setting off the surface and buried weapons within the explosive terrain environment. The explosion of the fuel cloud 13 creates an explosive overpressure. The activation of the light source and the deployment of the markers from housing 22 are both initiated when the explosive overpressure creates an external pressure for pushing the lid piston assembly 74, seen in FIGS. 7 and 9, and the piston collar 76 into the outer case 64 in order to break the ampule 68 and for forcing the initiating means schematically represented at 44 as a piston-type initiator device, behind initiator guard 46 seen in FIG. 6. The initiator device 44 in turn initiates the action of the timer and release mechanism 52. The timer cycle cpncludes with the release of each lid release latch 62 in FIG. 9 on each of the lids 60 of the respective probe compartments 26. The spring biased probes 54 extend outward from the lane marker housing 22 as the lid 60 is released and the two probes are deployed, thereby completing the deployment cycle of the lane marker. It will be understood that mechanical timer mechanisms are known that can be used as the described timer and release mechanism 52 and that the choice of a particular mechanism may be made by those skilled in the art. For example, a timer mechanism similar to the one shown and described in co-pending application Serial No. 332,851 may be adapted for use with this invention by one skilled in the art. Therefore, it is not necessary to described the timer and release mechanism in any greater detail.

The aforementioned.activation of the chemiluminescent light source is another feature of the present invention. In a preferred embodiment the chemiluminescent light source 56 is activated when the lid piston assembly 74 and the piston collar 76 push and break the glass ampule 68 containing the oxidizer solution. The outer case 64 deforms or otherwise allows transmission of the force from the lid piston assembly 74, and the piston oollar 76 to break the glass ampule 68. The ampule breaks and allows the oxidizer solution to mix with the flourescer solution 70 within the case and produce a conventional chemiluminescent light.

Lid 60 is subsequently freed to fall away upon the timed release of the release latch 62. The spring biased probes 54 are then unrestrained and the spring bias of the probes act to extend the probes and deploy the activated light source and any other daytime marker as desired. The activated light source 56 and flag 58 in a preferred embodiment are deployed from their respective probe or marker storage housings or compartments 26, extending to a minimum length of approximately 22 inches outward from the housing 22 in a preferred embodiment.

While specific embodiments have been shown and described, many variations are possible. The particular shape of the housing, probe compartments or probes, or any of the attitude control springs including all dimensions or materials may be changed as desired to suit the carriers with which this invention is used. The housing material may vary although nylon is preferred. The configuration and number of probe compartments may vary although the preferred embodiment shows two probe compartments spaced such that in the worst landing position at least one probe will extend up at a minimum angle of 45° with the ground. This feature is an improvement over conventional lane markers which may provide an extra number of markers merely to insure that at least one marker is deployed so as to be visible.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of this invention be determined by the appended claims and their equivalents.

I claim:

1. An apparatus for marking the post-detonation safe area within an explosive terrain, comprising:

a marking apparatus assembly adapted for delivery to a desired area by a remotely launched device, the assembly including a housing means;

means for ejecting the marking apparatus assembly from the launched device, said ejecting means operatively associated with said marking apparatus assembly;

a plurality of marking means for marking a post-detonation safe area included within the housing means;

extension means for extending said marking means, operatively associated with said marking means; and initiating means for initiating said extension means and an activating means for providing a night marker, said initiating means operating in response to an external pressure source, said initiating means operatively associated with said activating means and said extension means.

2. An apparatus for marking post-detonation safe area within an explosive terrain as set forth in claim 1 wherein the apparatus further comprises means for determining post-ejection attitude of the marking apparatus operatively associated with said marking apparatus and contained within said marking apparatus housing means and deployed intermediate ejection of said housing means and extension of said marking means.

3. An apparatus for marking a post-detonation safe area as set forth in claim 1 wherein said housing means comprises a generally cylindrical housing capable of delivery to the intended terrain by a catapult-launched fuel air explosive weapon system.

4. An apparatus for marking a post-detonation safe area as set forth in claim 1 wherein said ejecting means comprises a piston activated by a fuze upon contact with the ground by the remotely launched device.

5. An apparatus for marking a post-detonation safe area as set forth in claim 1 wherein said extension means comprise an outwardly biased member, and a lid released by said initiating means after a desired time lapse following detonation of a fuel cloud released by the delivery device.

6. An apparatus for marking a post-detonation safe area as set forth in claim 1 wherein said initiating means comprises a piston-type initiator device activated by an explosive overpressure.

7. An apparatus for marking a post-detonation safe area as set forth in claim 1 wherein said housing means comprises at least two members mounted on opposing ends of sid housing means to prevent said housing means from coming to a rest position on an end.

8. An apparatus for marking the post-detonation safe area as set forth in claim 1 wherein said marking means comprises a chemiluminescent light.

9. An apparatus for marking the post-detonation safe area as set forth in claim 1 wherein said marking means comprises a flag.

10. An apparatus for marking a post-detonation safe area as set forth in claim 1 wherein said housing means comprises a bias means for biasing said housing means such that said housing means rests in a position providing for visiible deployment of at least one marking means.

11. An apparatus for marking the post-detonation safe area as set forth in claim 10 wherein said bias means includes a spiral spring circumferentially mounted in the proximity of an end of the housing means.

12. An apparatus for marking the post-detonation safe area within an explosive terrain, comprising:

a generally cylindrical housing capable of delivery to the intended terrain by a catapult-launched fuel air explosive weapon system;

a piston activated by a fuze upon contact with the ground, the piston associated with the generally cylindrical housing, the piston for ejecting a marking apparatus assembly from the launched device, the marking apparatus assembly including a plurality of means for marking a post-detonation safe area;

outwardly biased extension means for extending a plurality of markers, the extension means restrained by a lid;

an initiating means for releasing the lid after a desired time lapse following detonation of a fuel cloud released by the delivery device;

means for activating a chemiluminescent night marker associated with a marker storage compartment included within the marking apparatus assembly, the activating means responding to an explosive overpressure as a result of fuel cloud detonation; and means for determining post-ejection attitude of the marking apparatus operatively associated with the marking apparatus and contained within marking apparatus housing means and deployed intermediate ejection of housing means and extension of marking means.

13. An apparatus for marking a post-detonation safe area as set forth in claim 12 wherein said initiating means comprises a piston-type initiator device activated by an explosive overpressure.

14. An apparatus for marking a post-detonation safe area as set fortn in claim 12 wherein said post-ejection attitude determining means comprises at least two members mounted on opposing ends of said housing means to prevent said housing means from coming to a rest position on an end.

15. An apparatus for marking a post-detonation safe area as set forth in claim 12 wherein the chemiluminescent night marker includes a light source having an outer case containing a green flourescer solution and an inner support casing for holding an elongated glass ampule filled with an oxidizer solution.

16. An apparatus for marking a post-detonation safe area as set forth in claim 12 wherein the marking apparatus asesembly further includes a probe comparmtment piston and collar assembly that moves in response to an external explosive overpressure, the moving piston activates a marker comprising a chemiluminescent light source when the piston and collar assembly, which extends through a hole in a probe compartment lid, slide through the hole in the lid so that the collar and piston assembly deform a portion of a light source housing, breaking the glass ampule filled with an oxidizer solution so as to allow mixture of the oxidizer solution and a flourescer to activate the light source.

17. An apparatus for marking a post-detonation safe area as set forth in claim 12 wherein said post-ejection attitude determining means comprises means for biasing housing means such that housing means rests in a position providing for visible deployment of at least one marking means.

18. An apparatus for marking the post-detonation safe area as set forth in claim 17 wherein said bias means includes a spiral spring circumferentially mounted in the proximity of an end of the housing means.

* * * * *